US006776003B1

(12) United States Patent
Bollen

(10) Patent No.: US 6,776,003 B1
(45) Date of Patent: Aug. 17, 2004

(54) CONTAINER

(75) Inventor: Arthur Frank Bollen, Ngahinapouri (NZ)

(73) Assignee: QPod Systems Limited, Auckland (NZ)

( * ) Notice: Subject to any disclaimer, the term of this patent is extended or adjusted under 35 U.S.C. 154(b) by 0 days.

(21) Appl. No.: 10/009,263

(22) PCT Filed: Jun. 7, 2000

(86) PCT No.: PCT/NZ00/00092

§ 371 (c)(1),
(2), (4) Date: Mar. 11, 2002

(87) PCT Pub. No.: WO00/75041

PCT Pub. Date: Dec. 14, 2000

(30) Foreign Application Priority Data

Jun. 8, 1999 (NZ) ..... 336144

(51) Int. Cl.[7] ..... F25D 17/04; F25D 17/06
(52) U.S. Cl. ..... 62/407; 62/434; 62/419
(58) Field of Search ..... 62/407, 434, 411, 62/419, 408, 98, 99, 371; 220/1.5, 592.02, 592.09

(56) References Cited

U.S. PATENT DOCUMENTS

| | | | | |
|---|---|---|---|---|
| 2,586,893 A | * | 2/1952 | Westling | 62/408 |
| 3,604,218 A | * | 9/1971 | Cresti | 62/408 |
| 4,386,703 A | | 6/1983 | Thompson et al. | |
| 5,548,967 A | | 8/1996 | Ghiraldi | |
| 5,978,218 A | | 11/1999 | Fujimoto et al. | |
| 5,987,912 A | * | 11/1999 | Flessner | 62/407 |

FOREIGN PATENT DOCUMENTS

| | | |
|---|---|---|
| EP | 0 832 826 A1 | 4/1998 |
| FR | 2649381 | 1/1991 |
| RU | 2078494 C1 | 5/1997 |
| SU | 1784134 A1 | 12/1992 |
| TW | 107093 | 4/1987 |
| WO | 90/05098 | 5/1990 |
| WO | 95/22728 | 8/1995 |
| WO | 95/22729 | 8/1995 |

* cited by examiner

*Primary Examiner*—Chen-Wen Jiang
(74) *Attorney, Agent, or Firm*—Young & Thompson

(57) ABSTRACT

The invention relates to containers which can be placed within a shipping container. At least one wall (20, 21, 22, 23) of the container has ducts (32, 33) through which cooling (or heated) gas may pass.

6 Claims, 6 Drawing Sheets

CONTAINER

TECHNICAL FIELD OF THE INVENTION

This invention relates to a container which has been deed particularly though not necessarily solely for the transport of fresh produce such as vegetables, fruit, fish and meat. It is envisaged however that other items such as semiconductors and the like could also be transported in the containers of the invention.

BACKGROUND ART

Accurate temperature control during the transportation of perishable products in a container is important in order to maximise their storage or shelf life. Distribution of temperature controlled air within a transport vehicle or storage facility is an important feature of the refrigeration system.

The smaller the transport or storage container the greater its surface area is in relation to its volume. Heat is gained by transfer through the walls of the transport container. The smaller the container, the greater percentage of its cargo volume that is in contact with or in close proximity to the containers' walls (the surface area) thus making it harder to refrigerate.

The means by which temperature controlled air is circulated within a transport container is vitally important in order to avoid hot spots developing in the perishable cargo. The most common methods of air circulation used in refrigerated transport systems is either bottom air delivery or top air delivery into the container.

Typically the refrigeration plant is mounted at one end of the transport vehicle. Air is cycled through heat transfer coils, then passes into a single air duct entering the cargo area, either along the containers' floor or roof, and returns through a single inlet, also located at the machinery plant end of the transport vehicle, but usually at the opposite side to the outlet duct. For example, in a refrigerated sea container, if the outlet duct is positioned near the floor of the cargo area then the inlet duct would be positioned near the roof of the cargo area. The air distribution cycle is continuous during the refrigeration process.

For refrigerated trucks and sea containers this method is considered by operators to be satisfactory. Variations in perishable products temperature measured at different locations within transport vehicles are commonly acknowledged but generally within acceptable limits for the trade.

Applying the same air distribution system to smaller containers, (the size of a loaded pallet) has not been successful due to a larger percentage of the perishable cargoes' volume being in contact or in close with, or close proximity to the containers' walls.

OBJECT

It is therefore an object of the present invention to provide a container which will go at least some way towards obviating or minimising the foregoing disadvantages in a simple yet effective manner or which will at least provide the public with a useful choice.

DISCLOSURE OF INVENTION

Accordingly in one aspect the invention consists in a container comprising a base, a plurality of side walls and a top, at least some of the side walls having ducts therein through which gas can flow.

In a further aspect the invention consists in a container comprising a base, a plurality of side walls and a top, there being ducts within at least some side walls, and a gas moving device arranged to direct gas through said ducts.

In a still further aspect the invention consists in a method of maintaining the temperature of or cooling a container having a top, a bottom, and a plurality of side walls comprising the steps of directing a flow of gas at the desired temperature up or down through one or more sides of the container and allowing the gas to return down or up through other side walls, or through the body of the container.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF DRAWINGS

One preferred form of the invention will now be described with reference to the accompanying drawings in which.

BEST MODE FOR CARRYING OUT THE INVENTION

Figure 1:
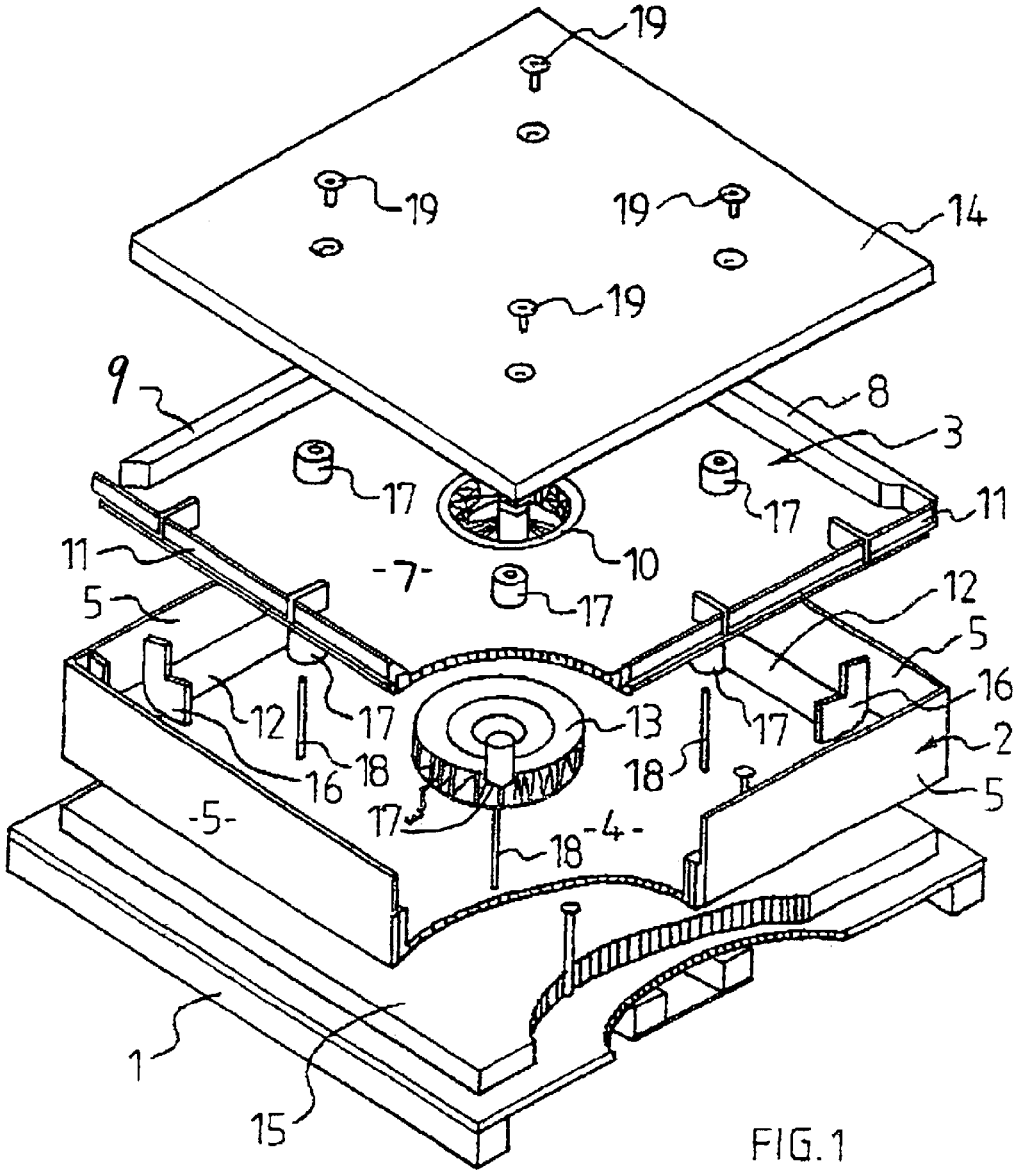
FIG. 1 is an exploded third angle view showing the base of a container according to the invention.
Figure 3:
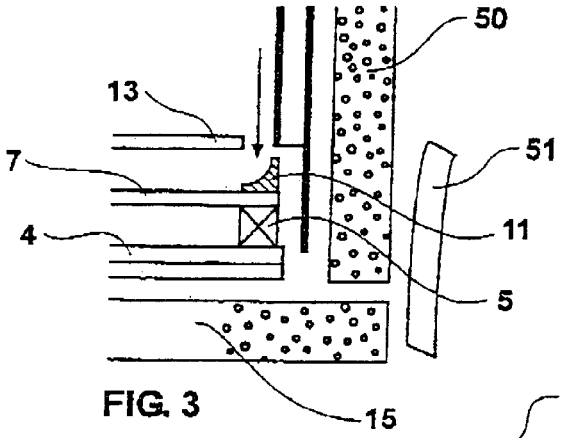
FIG. 3 is a slightly exploded view of a junction between a wall and the base of the container of FIGS. 1 and 2.

Referring to FIGS. 1 to 16, a container is provided as follows:

The container comprises a base, a top and a plurality, preferably four, side walls. The base may be mounted on a pallet 1. Means are provided to move gas in a manner that will be described in more detail hereinafter and the means may be in the base or the top. In the preferred form the gas moving device is in the base. In such a construction the base comprises two parts being a lower part 2 and an upper part 3. In one preferred form of the invention gas will be moved upwardly and within two side walls of the container and downwardly and within two side walls. Other variations are able to be provided such as up one side and down one side, up three side walls and down one or up one and down three. Other alternative, include up four walls and down through the body of the container and allowing the gas to enter the body of the container at various points up the side walls. In the up two walls, down two walls version the lower part 2 is provided with a base 4 and perimeter walls 5 are provided on the base 4. The upper part 3 has a base 7 and walls 8 and 9 on the two edges thereof. The base 7 of the upper part 3 has a central aperture 10 through which gas can pass. The other two sides of the base 7 may have a curved side wall 11 thereabouts to assist in directing the in gas flow in use. The sides of the base 4 also carry a curved wall so that the side of base 4 which carry a curved wall 12 sit under sides of base 7 which do not carry a curved wall. A gas moving device such as a radial fan 13 is provided to move gas through the central aperture 10. A top plate 14 is provided above the upper part 3 so that in effect upper and lower plenum chambers are provided in the base along with the gas moving device. A layer of insulation 15 may be provided between the base and the pallet as shown in FIGS. 1 and 3. The base 7 may rest on notched vanes 16 carried on the inside of walls 5. The vanes 16 also direct air evenly into the duct. The base 7 and top plate 14 are also supported by spacers 17 through which bolts 18 pass to secure the construction by use of nuts 19.

Figure 5:
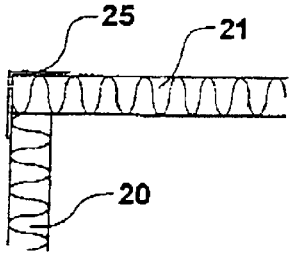
FIG. 5 is a corner detail of the container of the invention.
Figure 4:
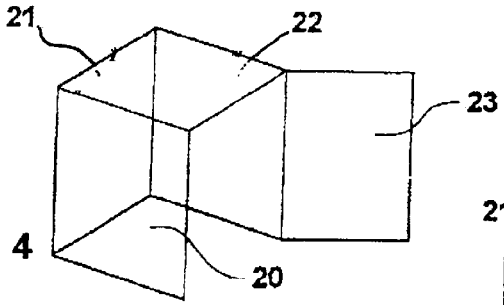
FIG. 4 is a diagrammatic representation of the walls and top of a container according to the invention.
Figure 7:
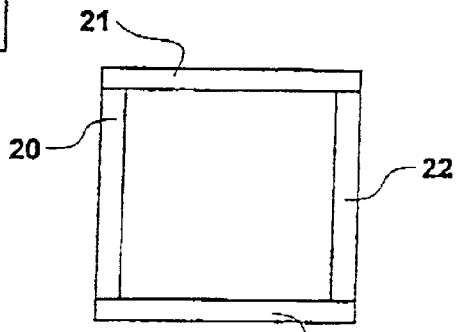
FIG. 7 is a simplified drawing of an arrangement of the sides of the invention.
Figure 6:
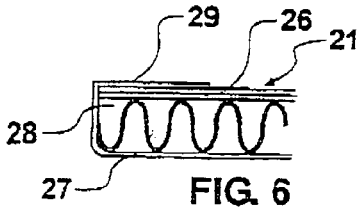
FIG. 6 is an enlarged view of the end of a fluted side wall according to the invention.

The walls of the container comprise walls 20, 21, 22 and 23 of which one for example the wall 23 may be in the form of a door. Thus the side walls 21 and 23 for example may be wider than walls 20 and 22 so that walls 21 and 23 overlap the ends of the side walls 20 and 22 as can be seen in FIG. 7. In the preferred form of the invention the walls are made from fluted cardboard and a satisfactory cardboard is correctly provided by Carter Holt Harvey Limited and sold under the trade mark M FLUTE. This board provides sufficient rigidity and also provides flutes which form ducts along which the gas for example air can pass. In the construction as shown in FIG. 5 the wall 20 butts against a face of the wall 21 and a tape 25 is passed vertically and around the corners to hold the walls in position. The containers is also usually wrapped in plastic wrap. In FIG. 6 the wall 21, for example, is shown it can be seen that the outer surfer has a double thickness of cardboard at 26 and that the inner wall 27 has been extended around the end of the wall 28 and secured back to the outer surface at 29.

Figure 9:
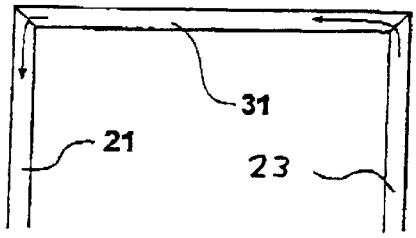
FIG. 9 as for FIG. 8.
Figure 10:
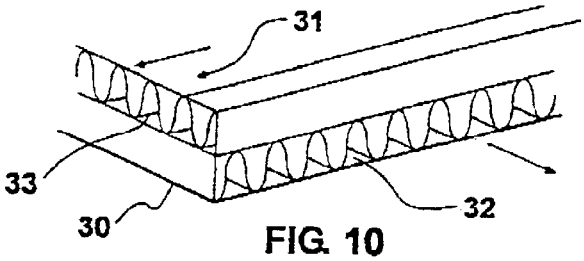
FIG. 10 shows the arrangement of a preferred form of top for the container.
Figure 11:
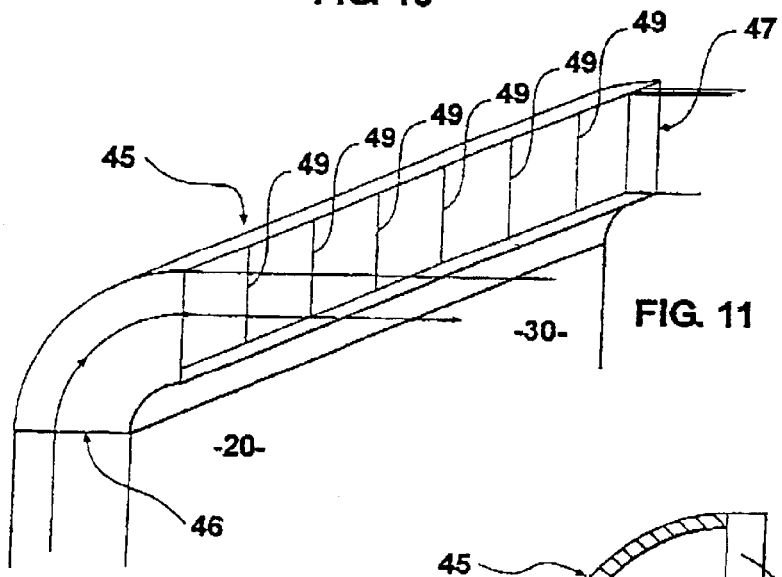
FIG. 11 shows a top corner connector for a preferred container.
Figure 12:
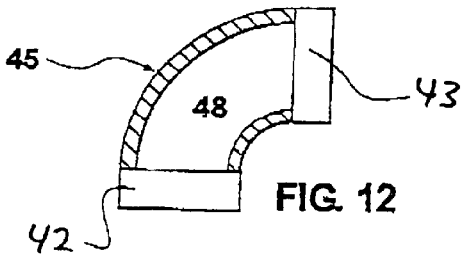
FIG. 12 shows a cross section of the connector of FIG. 11.

The top includes one or more chambers and a satisfactory construction is substantially as shown in FIG. 10 in which two layers of the fluted cardboard are provided being layers 30 and 31 in which the flutes 32 and 33 are substantially at right angles. This keeps the air flows separate and enables the air to pass up one wall such as wall 20 through flutes such as flutes 33 and down the other side wall such as side wall 22. It will be apparent of course that a single plenum could be provided or two plenum chambers without the flutes but it is believed that the preferred embodiment comprises the construction as shown in FIG. 10. FIG. 11 shows one way of completing gas passageways from say wall 20 to top part 30. A connector 45 is provided having gas passageways 48 between face 46 and face 47. There may be dividers 49 within the passageways 48. The faces 46 and 47 are recessed at 42, 43 to provide a female member into which the side panel 20 and top panel 30 engage. Other connections can be similarly made. An alternative method is simply to "V" notch a length of cardboard in two places so that the length folds up to form a pair of sides separated by a top with the flutes aligning at the folds. The embodiment in FIG. 9 shows this type of construction.

Figure 8:
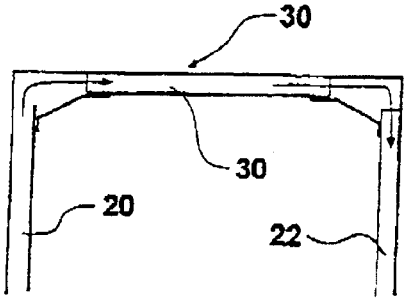
FIG. 8 show gas paths across the top of the container in the preferred form of the invention.
Figure 13:
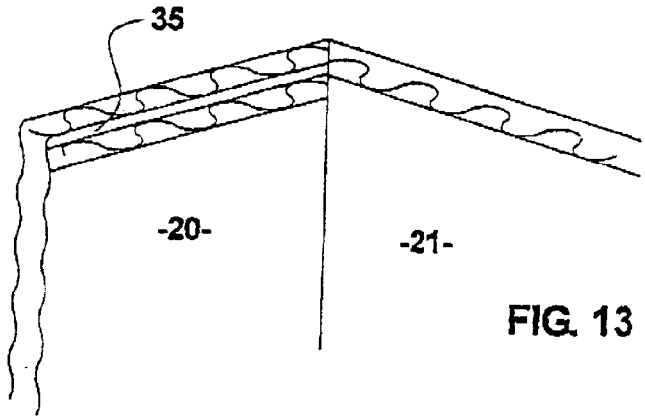
FIG. 13 is a corner assembly for the container of the invention.
Figure 14:
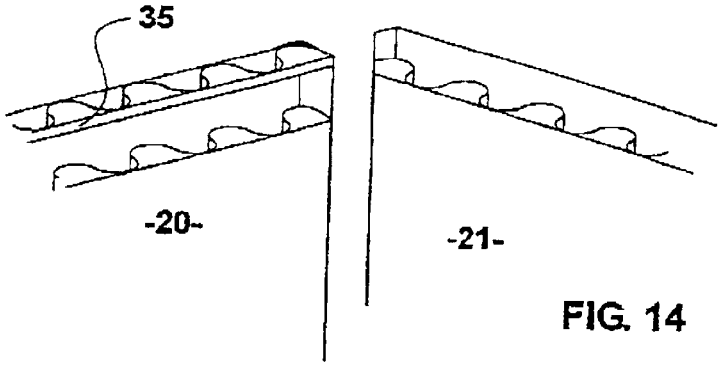
FIG. 14 shows FIG. 13 in exploded form.

Thus by reference to FIG. 8 air passes up wall 20 into top part 30 and down walls 22. FIG. 13 shows the corner assembly which it can be seen that the flutes in wall 20 terminate at a lower level than the flutes in wall 21 and the extension 35 can be seen. The inner face of the walls could have the cardboard replaced by material which transfer heat more readily but which gives sufficient strength such as a metal sheet for example although this has the disadvantage that the container walls may not be so readily disposed of at the receiving end. Also an array of holes could be provided on the gas supplying and gas receiving walls so that the gas passes through the produce rather than over the top or as well as through the top. Such a construction is of particular advantage when the produce is horticultural items. In such a construction selected pathways can be blocked to force flow through the produce.

Air flows up two opposite sides and down the remaining two opposite sides are also possible.

That is the air flow is across a corner.

Figure 16:
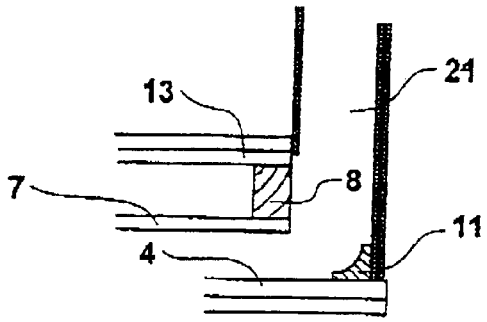
FIG. 16 is a similar detail but showing the gas supply intersection to the base and the side walls.
Figure 15:
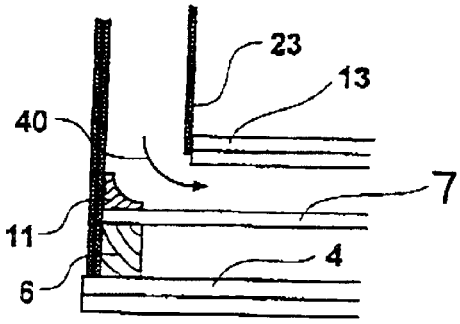
FIG. 15 shows the detail of the junction between the side walls and the base of one intersection thereof being the gas receiving intersection to the base.

Referring to FIG. 15 and FIG. 16 it can be seen that air will return down the side flutes for example wall 23 in the direction of arrow 40. The gas moving device 13 such as a radial fan will move that gas through the aperture 10 into the lower chamber where it is enabled to move up the flutes in wall 21.

In one base chamber a refrigeration unit (not shown) or heating unit is provided. It is expected that usually a cooling unit will be provided, but a heating unit may be used, or both heating units and cooling units can be provided.

Figure 2:
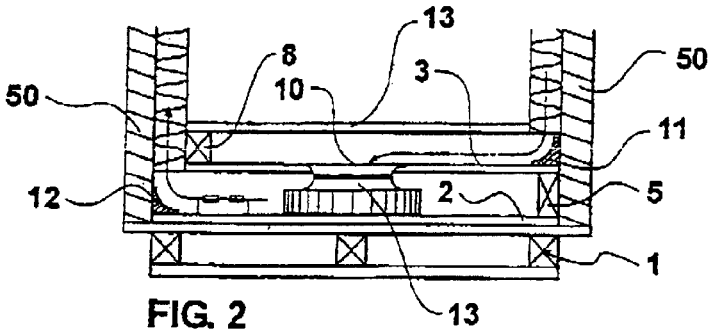
FIG. 2 is a cross sectional view of the lower end of a container according to one preferred form of the invention.

In use the door 23 is opened and produce or items stacked within the container. The door 23 is closed and insulation panels 50 indicted in FIGS. 2 and 3 are placed about the container. These are then taped so as to be secure in position and a tape is indicated at FIG. 51. Other fixing devices could be used as available.

Once closed the container of the invention may be shipped as desired for example within a shipping container or individually as suitable.

Power is supplied to the gas moving device 13 and air (or other gas if utilised) is moved up to or in some cases one or three side walls across the top of the container (unless blocked to direct the flow through the produce) and down the remaining two or three or one side walls back into the base. It will be apparent that the roles of the base and top could be reversed in some instances although having the cooling and gas moving functions in the base enables it is believed a simpler construction. The construction has the advantage of shipping a collapsible container on a pallet. In summary this embodiment of the invention in a preferred form could be described as a pallet base, with internal air plenums, a fan, four side walls and one horizontal roof wall. The walls contain air ducts. The fan forces air up two wall, across the roof, down the walls and back to the fan thus completing the air distribution cycles. This unique configuration enables two independent air cycles to work at 90 degrees to each other. Because the air is evenly forced through all the walls, heat transfer through the container walls is controlled accurately. This is ideal for non-respiring perishable products such as meat, which is typically packaged in boxes which do not contain air vents.

This construction forms essentially a cool gas "blanket" about the produce and is particularly suitable for meat products which give off little or no heat while stored an/or transported. The "blanket" in effect insulates the contents in the container from the outside ambient air.

For perishable horticultural products which respire and give off heat, it is necessary for the temperature controlled air to flow through the vents in the product boxes and around and/or across the product to take away the heat and control the product's temperature accurately. In this case either of the following air distribution options could be used.

Figure 17:
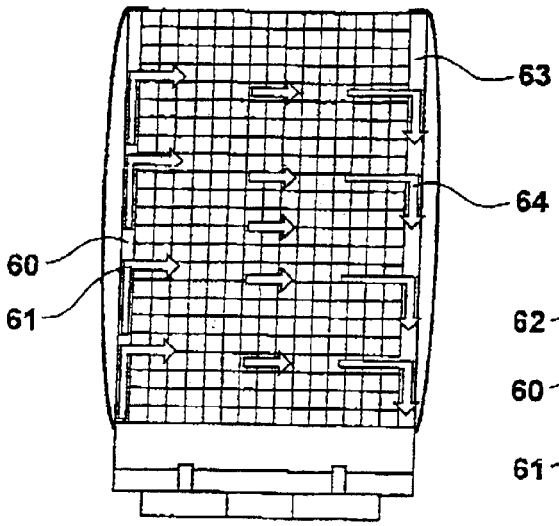
FIG. 17 is a diagrammatic side elevation of an alternative embodiment of a container according to the invention.
Figure 18:
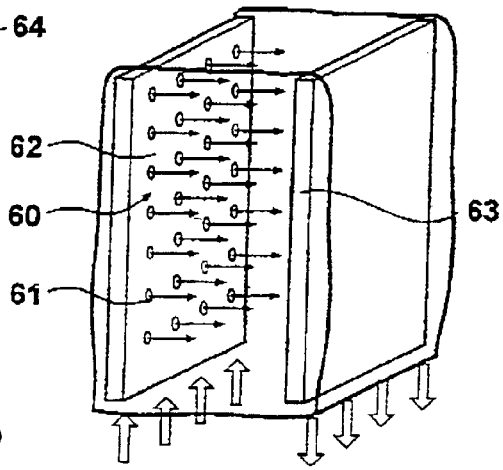
FIG. 18 is a diagrammatic perspective view of the container of FIG. 17.

Up through one side wall and across to its opposite side wall as shown in FIG. 17 and FIG. 18.

In this form of the invention, air is forced from the fan, up one wall 60, through apertures 61 located within its inner wall 62 (on the cargo side), through the cargo and across to its apposite side wall 63, through holes 64 located in the inner wall of the second or opposite side wall, and through this wall back to the fan.

In this embodiment the aperture 61 should, in area, be less than, or at most, equal to the area of the input to the ducts. If the total area is close to the input area then desirably upper apertures should be larger than lower apertures. When the aperture area is much less, such graduation is less necessary.

Figure 19:
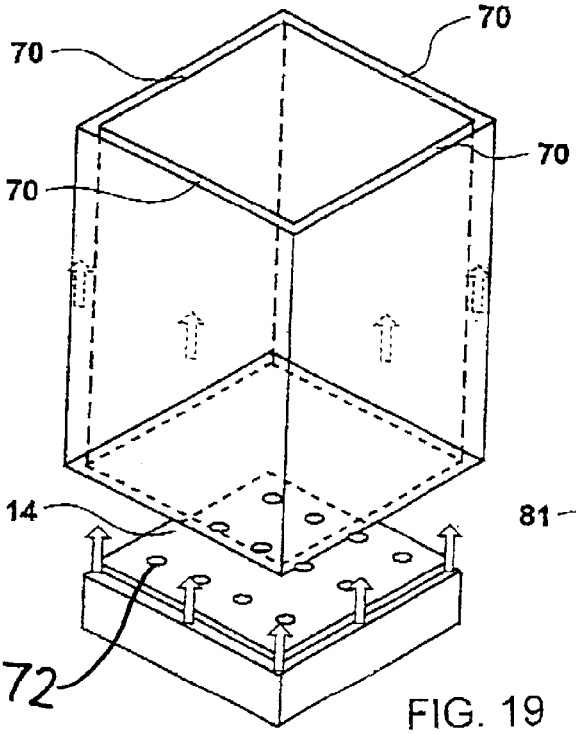
FIG. 19 shows a further alternative container according to the invention.

Up four walls and down through the cargo, as shown in FIG. 19.

Figure 20:
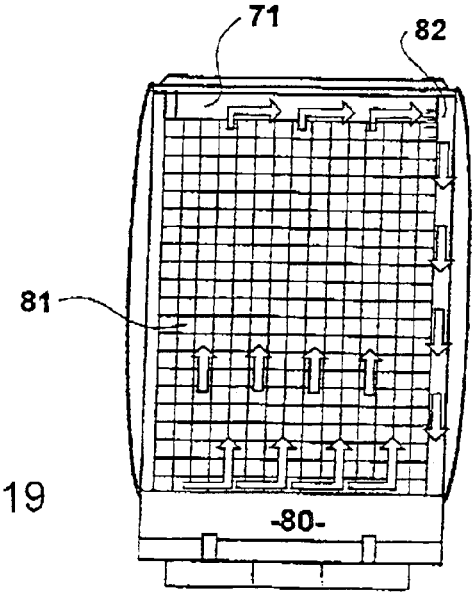
FIG. 20 shows a still further alternative container according to the invention.

An alternative form of the invention provides an air circulation system at enable the air to travel up each of the four walls 70 to the top of the loaded pallet, into a plenum, not shown in FIG. 19, but referenced 71 in FIG. 20.

Apertures 72 would be provided in plate 14 to maintain even air flow distribution. In an alternative embodiment an apertured plate (not shown) could be placed near the top of the walls to form a plenum chamber through which the air passes.

Up the cargo and down through one or more side walls, as shown in FIG. 20.

In yet another form of the invention air is forced from the fan up through a plenum 80 located underneath the cargo 81, up through the cargo and returns down and through one or more walls 82 back to the fan.

This construction is essentially the reverse of the construction of FIG. 19 in respect of the air flow direction.

Figure 21:
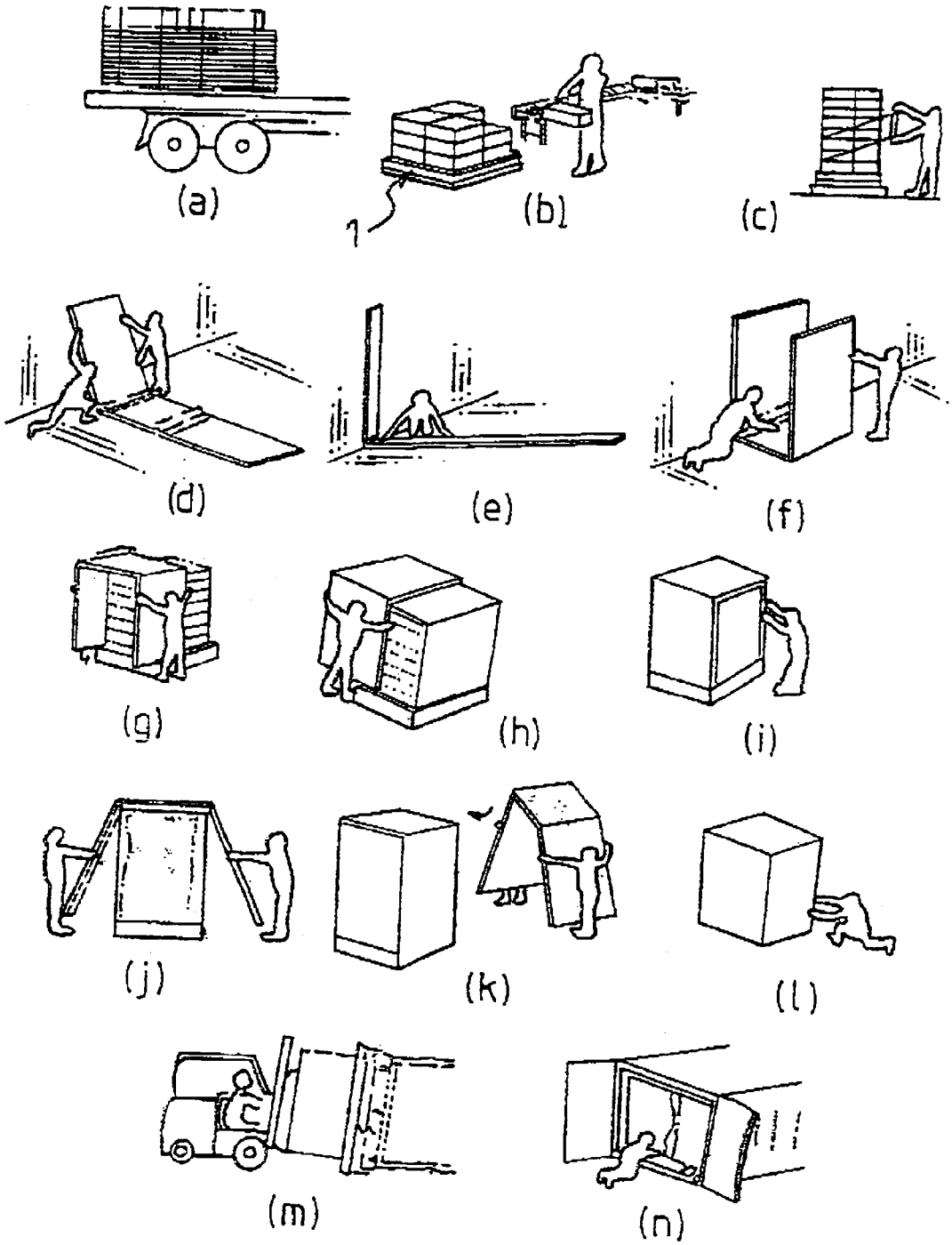
FIG. 21 (*a*) to (*n*) is a series of drawings showing an erection sequence of a container.

FIG. 21 part (*a*) to (*n*) shows an assembly sequence of the construction.

In FIG. 21 (*a*) the parts of the container are shown arriving. In 21 (*b*) produce is stacked onto a pallet 1, and in (c) the produce is optionally wrapped for example using shrink film.

In (d) to (f) the first of the directing panels is folding into shape and in (g) is placed over the produce. In (h) the second panel also folded is placed over the first panel and these are sealed at (i). In (j) to (l) a similar procedure is followed with insulation panels which also extend over the pallet 1. The box may be wrapped in shrink film at this stage to seal gaps between cardboard. Alternatively a bag could be used. Drawings (m) to (n) show the loaded container of the invention being lifted and loaded into a larger shipping container. This construction is for an embodiment where gas passes up two sides across the top and down the other two sides. The air paths at the top cross over but are not intersecting.

Thus it can be seen that a container is provided which at least in the preferred forms, allows cargo to be cooled (or heated, if the refrigeration plant is replaced with a heater) in a manner such that hot spots (or cool spots) are minimised even with small containers.

What is claimed is:

1. A container comprising a base, four side walls and a top, the side walls having ducts therein through which gas can flow, wherein the gas moves up an adjacent pair of said side walls and down an opposing adjacent pair of side walls to form a pair of pathways, the pair of pathways crossing each other at the top without intersection of the pathways.

2. A container comprising:

a base, four side walls and a top, there being ducts within the base, the side walls and the top, and a gas moving device arranged to direct gas through said side walls into said top, and through said side walls into said base, wherein two separate gas paths are provided.

3. A container comprising:

a base, four side walls and a top, there being ducts within the base, the side walls and the top, and a gas moving device arranged to direct gas through said side walls into said top, and through said side walls into said base, wherein the top includes two chambers or sets of ducts, gas in one gas path passing through one chamber or set of ducts and gas in another gas path passing through the other.

4. A method of maintaining the temperature of or cooling a container having a top, a bottom, and a plurality of side walls comprising the steps of:

directing a first flow of gas at the desired temperature up or down through one sidewall of the container and allowing the gas to return down or up through another side wall, and directing a second flow of gas at the desired temperature up or down through yet another sidewall of the container and allowing the gas to return down or up through still yet another side wall, wherein the first flow of gas and second flow of gas are through side walls selected so that the first flow of gas and second flow of gas are separate in the walls.

5. A method as claimed in claim 4 wherein the gas moves up two side walls and down two side walls.

6. A method as claimed in claim 4 wherein the top has two ducts so that the first flow of gas and second flow of gas are also separate in the top.

* * * * *